US011944912B2

(12) United States Patent
Redden

(10) Patent No.: US 11,944,912 B2
(45) Date of Patent: Apr. 2, 2024

(54) MULTI-PLAYER GAME SYSTEM

(71) Applicant: John Redden, Leavenworth, KS (US)

(72) Inventor: John Redden, Leavenworth, KS (US)

( * ) Notice: Subject to any disclaimer, the term of this patent is extended or adjusted under 35 U.S.C. 154(b) by 186 days.

(21) Appl. No.: 17/354,890

(22) Filed: Jun. 22, 2021

(65) Prior Publication Data

US 2022/0401823 A1 Dec. 22, 2022

(51) Int. Cl.
*A63F 3/00* (2006.01)

(52) U.S. Cl.
CPC ..... *A63F 3/00697* (2013.01); *A63F 3/00176* (2013.01); *A63F 2003/00179* (2013.01); *A63F 2003/00195* (2013.01); *A63F 2003/00482* (2013.01); *A63F 2003/00757* (2013.01); *A63F 2003/00835* (2013.01); *A63F 2003/00845* (2013.01); *A63F 2003/00971* (2013.01)

(58) Field of Classification Search
CPC ..... A63F 3/00697; A63F 3/00176; A63F 2003/00179; A63F 2003/00195; A63F 2003/00482; A63F 2003/00757; A63F 2003/00835; A63F 2003/00845; A63F 2003/00971; A63F 3/0023; A63F 2003/00246; A63F 3/00075; A63F 3/02; A63F 2011/0062; A63F 2011/0072
See application file for complete search history.

(56) References Cited

U.S. PATENT DOCUMENTS

| | | | | |
|---|---|---|---|---|
| 4,331,333 | A | 5/1982 | Willcocks | |
| 4,541,634 | A * | 9/1985 | Nolan | A63F 3/00 273/288 |
| 4,739,992 | A | 4/1988 | May | |
| 5,014,995 | A * | 5/1991 | Woodward | A63F 3/00176 D21/348 |
| 5,158,302 | A | 10/1992 | Rewega | |
| 9,168,455 | B2 | 10/2015 | Weisman | |
| 10,668,365 | B2 | 6/2020 | O'Connor | |
| 2001/0042959 | A1 * | 11/2001 | Reese | A63F 3/0423 273/243 |
| 2002/0167128 | A1 | 11/2002 | Selman | |
| 2005/0167915 | A1 * | 8/2005 | Otero | A63F 3/00006 273/242 |
| 2005/0236770 | A1 | 10/2005 | Hague | |
| 2016/0310834 | A1 | 10/2016 | Imus | |
| 2018/0028902 | A1 | 2/2018 | O'Connor | |

* cited by examiner

*Primary Examiner* — Michael D Dennis
(74) *Attorney, Agent, or Firm* — Hovey Williams LLP; Kameron D. Kelly

(57) ABSTRACT

A game system for playing a multi-player game. The game system comprises a hexagonal game board. The game board comprises a plurality of hexagonal cells on a top surface of the game board. The cells are separated into a plurality of kingdoms comprising kingdom cells, a plurality of battle-field cells, and a central cell. The game system additionally comprises a plurality of sets of game pieces. Each of the sets of game pieces is associated with one of the plurality of kingdoms. At least one of the game pieces from each of the plurality of sets of game pieces includes an indicia on the at least one game piece. The indicia is indicative of a legal maneuver permitted by the at least one game piece.

19 Claims, 12 Drawing Sheets

MULTI-PLAYER GAME SYSTEM

BACKGROUND OF THE INVENTION

Field of the Invention

The present invention relates to board games. More specifically, the present invention provides a multi-player game system with a game board and a plurality of game pieces in which players must compete to be the first to move a particular game piece from a home kingdom of the game board, completely around the game board, and into a central cell of the game board.

Description of Related Art

Board games are commonly played for pleasure and enjoyment. However, conventional board games have limited play possibilities and are often overplayed, and thus many players lose interest in repeatedly playing the same game. As such, there is need for a novel board game that incorporates strategic thought and vision, yet provides a unique and fun experience each time it is played. Further, many strategy board games (e.g., chess, checkers, backgammon, pente, etc.) are adapted for play between only two players. As a result, such games cannot accommodate larger groups. Thus, a strategy game is desired to provide unique, unlimited flexibility and to accommodate various numbers of players.

In view of the above, and as described in more detail below, the present board game invention, is based on fluid spatial recognition, substantially diverges in design elements and process steps from prior art board games. As such, and in view of the benefits provided by the present invention, embodiments of the present invention substantially fulfills a need in the art of board games.

SUMMARY OF THE INVENTION

The present invention is broadly concerned with a game system for playing a multi-player game. The game system may comprise a hexagonal game board. The game board comprises a plurality of hexagonal cells on a top surface of the game board. The cells are separated into (i) a plurality of kingdoms comprising kingdom cells, (ii) a plurality of battlefield cells, and (iii) a central cell. The game system additionally comprises a plurality of sets of game pieces. Each of the sets of game pieces is associated with one of the plurality of kingdoms. At least one of the game pieces from each of the plurality of sets of game pieces includes an indicia on the at least one game piece. The indicia is indicative of a legal maneuver permitted by the at least one game piece.

Embodiments of the present invention additionally include a method of playing a multi-player game. The method comprises a step of providing a hexagonal game board, with the game board including a plurality of hexagonal cells on a top surface of the game board. The cells are separated into (i) a plurality of kingdoms comprising kingdom cells, (ii) a plurality of battlefield cells, and (iii) a central cell. The method additionally comprises a step of providing a set of game pieces, with the set of game pieces being associated with one of the plurality of kingdoms. At least one of the game pieces from the set of game pieces includes an indicia on the at least one game piece. The indicia is indicative of a legal maneuver permitted by the at least one game piece. A further step of the method includes moving the at least one game piece that includes the indicia about the cells of the game board according to the legal maneuver indicated by the indicia.

This summary is not intended to identify essential features of the present invention, and is not intended to be used to limit the scope of the claims. These and other aspects of the present invention are described below in greater detail.

BRIEF DESCRIPTION OF THE DRAWINGS

Embodiments of the present invention are described in detail below with reference to the attached drawing figures, wherein.

Figure 1:
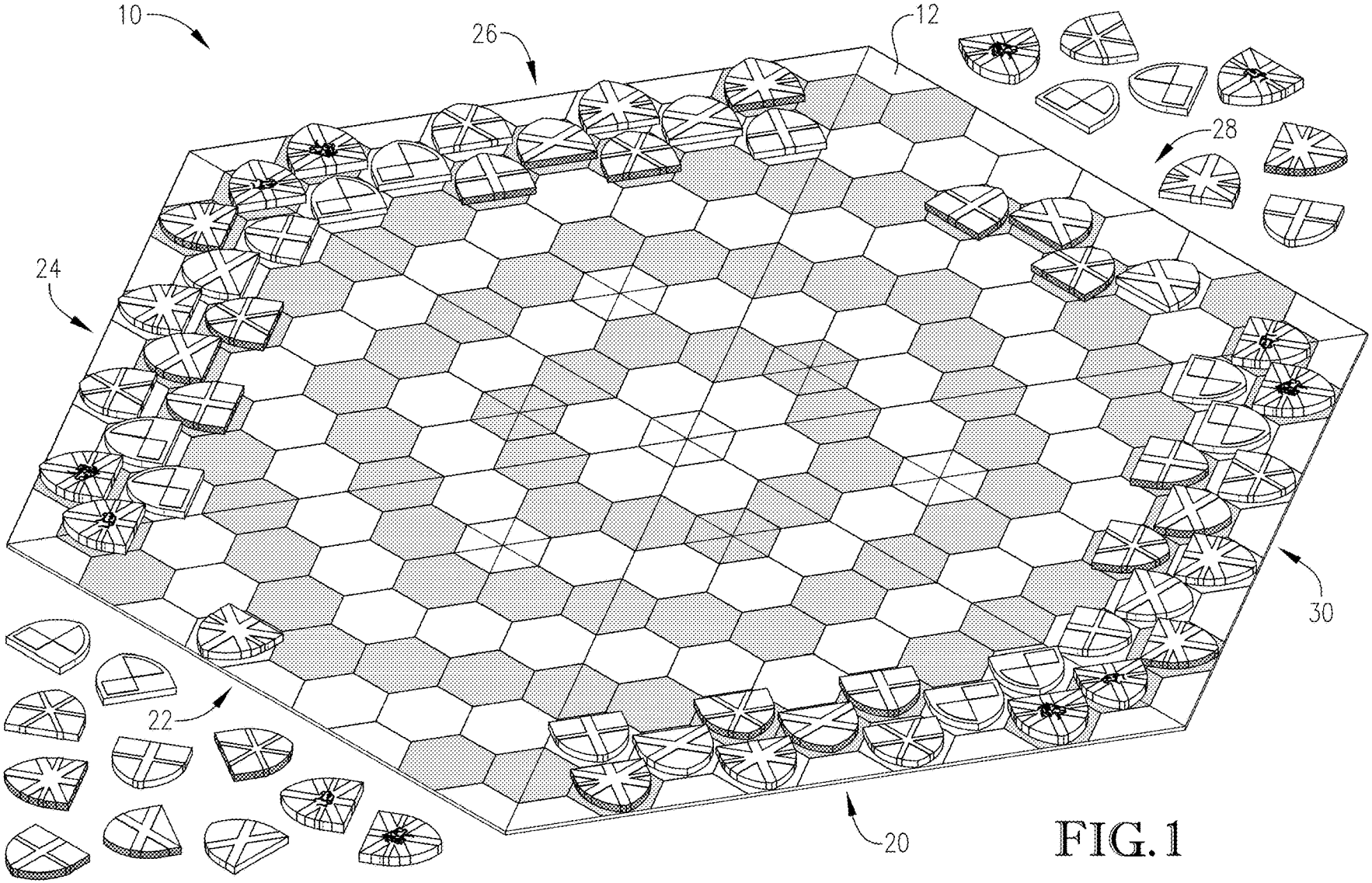
FIG. 1 is a perspective view of a board game system including a game board and a plurality of sets of game pieces according to embodiments of the present invention.

The figures are not intended to limit the present invention to the specific embodiments they depict. While the drawings do not necessarily provide exact dimensions or tolerances for the illustrated structures or components, the drawings are to scale with respect to the relationships between the components of the structures illustrated in the drawings.

DETAILED DESCRIPTION

The following detailed description of embodiments of the invention references the accompanying figures. The embodiments are intended to describe aspects of the invention in sufficient detail to enable those with ordinary skill in the art to practice the invention. Those of ordinary skill in the art may comprise those having ordinary skill in board game design and game play, including those skilled in two-dimensional (2D) special recognition. The embodiments of the invention are illustrated by way of example and not by way of limitation. Other embodiments may be utilized and changes may be made without departing from the scope of the claims. The following description is, therefore, not limiting. The scope of the present invention is defined only by the appended claims, along with the full scope of equivalents to which such claims are entitled.

In this description, references to "one embodiment," "an embodiment," or "embodiments" mean that the feature or features referred to are included in at least one embodiment of the invention. Separate references to "one embodiment," "an embodiment," or "embodiments" in this description do not necessarily refer to the same embodiment and are not mutually exclusive unless so stated. Specifically, a feature, component, action, step, etc. described in one embodiment may also be included in other embodiments, but is not necessarily included. Thus, particular implementations of the present invention can include a variety of combinations and/or integrations of the embodiments described herein.

Figure 2:
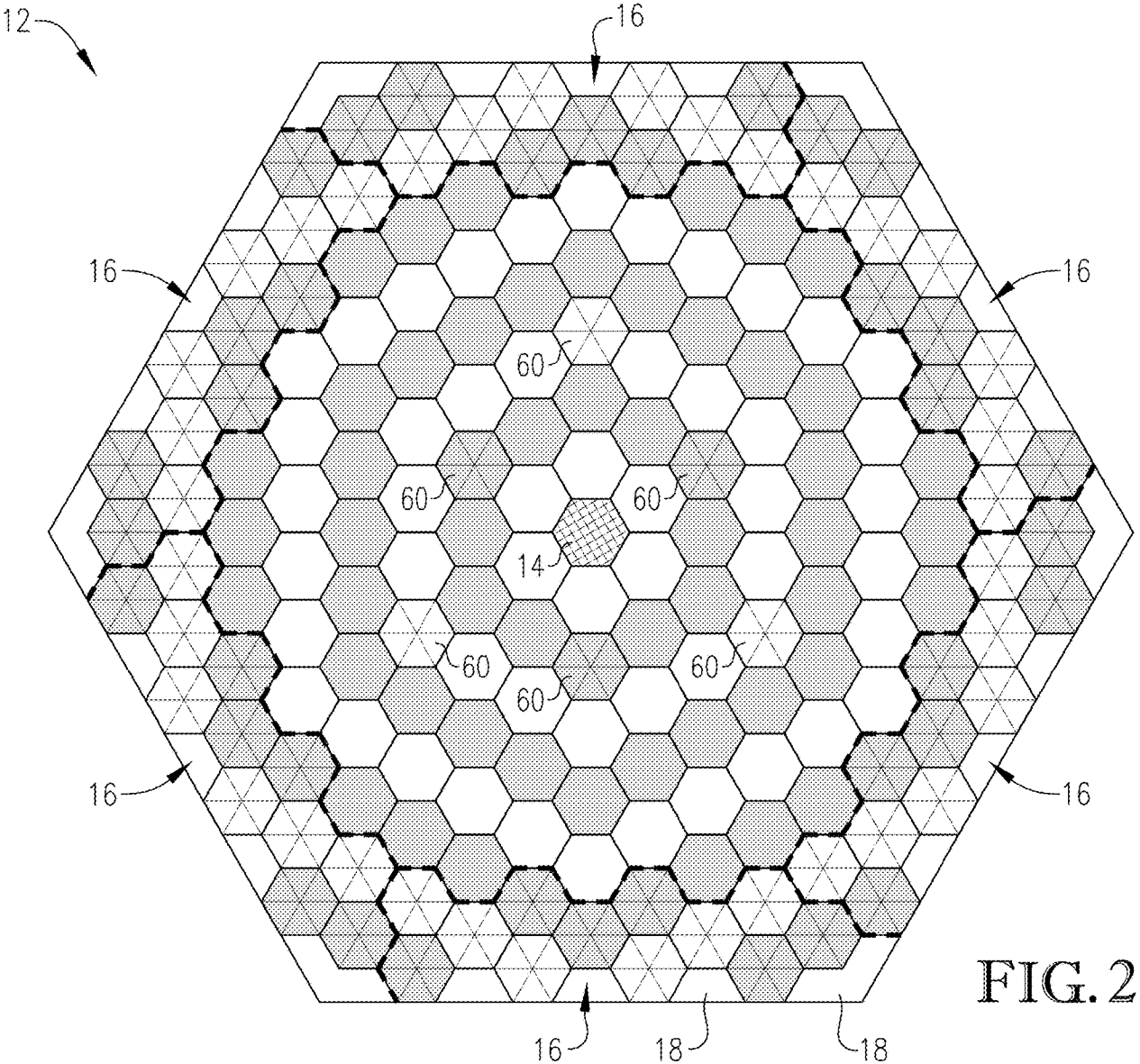
FIG. 2 is a top plan view of the game board from the system of FIG. 1.

The present invention is concerned with board game system and a method of playing a multi-player board game. An exemplary board game system 10 is illustrated in FIG. 1 and includes a game board 12 and a plurality of sets of game pieces positioned on or around the game board 12. The game board 12 is illustrated comprising a generally flat board (e.g., formed from wood, cardboard (or other paper product), plastic, or other similar material) and configured in the shape of a hexagon (i.e., the game board 12 is hexagonal, having six sides). Turning to FIG. 2, the game board 12 is illustrated as including a plurality of indicia or markings that separate the game board 12 into a plurality of hexagonal-shaped cells (i.e., the cells are hexagonal, having six sides). As will be described in more detail below, game play provides for a central cell 14, which is located at a center of the game board 12, to be a special cell. As such, the central cell 14 may be colored a specific, unique color or may have a particular indicia or marking that specifies its special status. The remaining cells of the game board will generally be colored white (or other light color) or dark. Dark is used herein to refer to a non-white color, such as black or gray. For example, as shown in the drawings, the cells of the game board 12 that immediately surround the central cell 14 in a concentric manner (referred to herein as the "inner ring") may be white. Contrastingly, the cells that immediately surround the inner ring of cells in a concentric manner may be dark. The game board 12 may include a plurality of alternating rings of white and dark cells, as shown in FIG. 2. The total number of cells, or number of rings of cells, of the game board may vary depending on the size of the game board 12 and/or on game play requirements.

Remaining with FIG. 2, the game board 12 may include six "kingdoms" 16, each comprising an area of cells ("kingdom cells") positioned adjacent to one of the six sides of the hexagonal game board 12. For example, as illustrated in FIG. 2, each kingdom 16 includes twelve cells positioned adjacent to one of the six sides of the game board 12. In some embodiments, the kingdoms 16 may comprise an even number of white and dark cells, such as six white cells and six dark cells. Furthermore, the kingdoms 16 may be positioned next to each other around the board 12, such that no cells are located directly between two adjacent kingdoms 16. As a result, the kingdoms 16 extend around, and form, a perimeter of the game board 12. FIG. 2 includes a number of bold-dashed lines which bound each of the six kingdoms 16 and separate the kingdoms 16 from each other and from the other cells of the board 12. The cells positioned between the kingdom cells and the central cell 14 are referred to herein as battlefield cells.

As noted above, and as illustrated in FIG. 1, the game system 10 may include a plurality of sets of game pieces. Each set of game pieces may be associated with one of the kingdoms 16. During game player, each player of the game may be assigned one of the sets of game pieces and one of the kingdoms 16. When a game begins, each of the player's game pieces (from the player's set of game pieces) will be positioned within the kingdom cells of the player's associated kingdom 16 (i.e., the "home kingdom"). To delineate each player's game pieces and kingdom 16, each set of game pieces and associated kingdom 16 may be highlighted with a unique base color (or other indicia or marking). For example, each of the six kingdoms 16 may be highlighted with a unique base color (e.g., purple, yellow, red, green, black, and blue). Such highlighting may be provided on or within the kingdom cells that comprise the respective kingdoms 16. Alternatively, or in addition, partial cells 18 (See, FIG. 2) present within the kingdoms 16 (which do not form part of the playable area of the board 12) may be colored with the unique base color to identify the kingdom 16. Correspondingly, each of the sets of game pieces will be highlighted (or otherwise marked with an indicia or marking) with the same unique base color as one of the kingdoms 16 (e.g., purple, yellow, red, green, black, and blue). As such, when during game player a player will be assigned a kingdom 16 and an associated set of game pieces, with such kingdom 16 and game pieces being highlighted with the same, unique base color (e.g., purple, yellow, red, green, black, and blue).

To further illustrate the concept of each of the kingdoms 16 and the associated game pieces being highlighted with unique base colors (or other indicia/markings), FIG. 1 illustrates a game board 12 with six kingdoms and six associated sets of game pieces. A first kingdom 20, and its associated set of twelve game pieces, may be highlighted with a distinct base color of purple (or otherwise marked with a unique indicia/marking). A second kingdom 22, and its associated set of twelve game pieces, may be highlighted with a distinct base color of yellow (or otherwise marked with a unique indicia/marking). A third kingdom 24, and its associated set of twelve game pieces, may be highlighted with a distinct base color of red (or otherwise marked with a unique indicia/marking). A fourth kingdom 26, and its associated set of twelve game pieces, may be highlighted with a distinct base color of green (or otherwise marked with a unique indicia/marking). A fifth kingdom 28, and its associated set of twelve game pieces, may be highlighted with a distinct base color of black (or otherwise marked with a unique indicia/marking). A sixth kingdom 30, and its associated set of twelve game pieces, may be highlighted with a distinct base color of blue (or otherwise marked with a unique indicia/marking).

During game play, the plurality of game pieces of the game system 10 are configured to move by their assigned players throughout cells of the board 12. Specifically, as noted above, each player playing the game will be assigned a set of game pieces. In some embodiments, the number of game pieces in a set will be twelve. However, the specific number and type of game pieces may vary. When a game begins, each of the twelve game pieces associated with a player will be positioned within one of the twelve kingdom cells of the player's kingdom 12. FIGS. 3*a*-3*g* illustrate exemplary game pieces that may be included within each set of game pieces. As discussed above, each set of game pieces associated with a player and a kingdom 12 may be highlighted with a particular base color (or another indicia/marking) that corresponds to the associated kingdom 12 (e.g., purple, yellow, red, green, black, and blue). In addition, each of the game pieces may include other indicia/markings that specify the type of game piece, as well as that indicate the type of movement about the game board 12 the game piece is allowed to legally perform, as will be discussed in more detail below.

In general, the game pieces may be shaped in the form of a shield with a horizontally-extending upper edge and a "U-shaped" lower edge. As noted above, each of the game pieces may be highlighted with a unique base color (or another indicia/marking) that corresponds to the base color of an associated kingdom 12 (e.g., purple, yellow, red, green, black, and blue). In addition, each of the game pieces will be formed with a thickness presenting a side edge (see, e.g., FIG. 1). In some embodiments, as shown in FIG. 1, the side edges of certain game pieces may be colored white or dark (or may be highlighted with some other indicia/marking), which is indicative of the type of cells of the game board 12 on which the game pieces may be legally positioned (e.g., which cells the game pieces may be legally "moved to" or "land on"). For example, a game piece with a white colored side edge may only be capable of being positioned on cells of the game board 12 that are white. In contrast, a game piece with a dark colored side edge may only be capable of being positioned on cells of the game board that are dark.

Figure 3F:
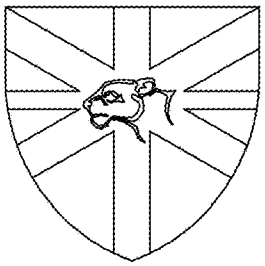
FIG. 3*f* is a top plan view of a game piece, in the form of a queen, from the game pieces of FIG. 1.
Figure 3G:
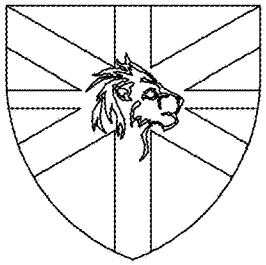
FIG. 3*g* is a top plan view of a game piece, in the form of a king, from the game pieces of FIG. 1.
Figure 3E:
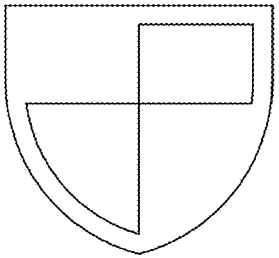
FIG. 3*e* is a top plan view of a game piece, in the form of a guard, from the game pieces of FIG. 1.
Figure 3D:
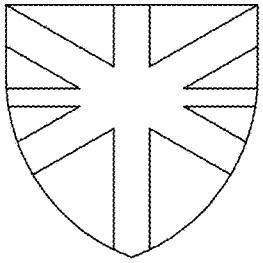
FIG. 3*d* is a top plan view of a game piece, in the form of an excalibur knight, from the game pieces of FIG. 1.
Figure 3C:
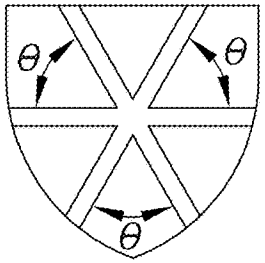
FIG. 3*c* is a top plan view of a game piece, in the form of a byzantine knight, from the game pieces of FIG. 1.

Furthermore, each of the game pieces may have other markings or indicia that identify the type of game piece, as well as identify how the game pieces can legally maneuver about the cells of the game board 12. For example, FIG. 3*a* illustrates a game piece in the form of a templar knight. The templar knight may include indicia/markings on a front surface (i.e., on a front surface of the shield) in the form of two intersecting, perpendicular lines shaped a cross. Specifically, the two lines may include a horizontal line that extends generally parallel with an upper edge of the game piece and a vertical line that extends orthogonal to the horizontal line. The horizontal line and the vertical line may intersect near a center of the front surface of the game piece. The horizontal line may have a thickness (e.g., about 0.125 inch) that is thinner than a thickness of the vertical line (e.g., about 0.25 inch). The lines may be colored differently than the base color of the associated game piece, such that the lines will stand out. For instance, the lines may be white or may be colored some other color distinct form the base color of the associated game piece. As will be described in more detail below, the cross-shaped lines of the templar knight (comprised of a horizontal line and a vertical line) may be indicative of the game piece's ability to legally maneuver horizontally and vertically about the cells of the game board 12.

Figure 3B:
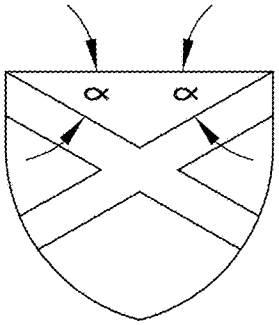
FIG. 3*b* is a top plan view of a game piece, in the form of a teutonic knight, from the game pieces of FIG. 1.
Figure 3A:
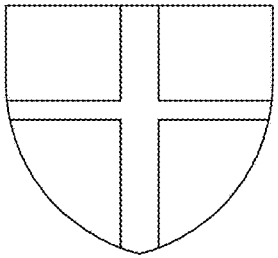
FIG. 3*a* is a top plan view of a game piece, in the form of a templar knight, from the game pieces of FIG. 1.

FIG. 3*b* illustrates a game piece in the form of a teutonic knight. The teutonic knight may include indicia/markings on a front surface (i.e., on a front surface of the shield) in the form of two intersecting, non-perpendicular lines in shaped as an "X." Specifically, each of the two lines may extend from opposite upper corners of the game piece and intersect near a center of the front surface of the game piece. In some embodiments, each of the two lines may form an angle $\alpha$ of approximately thirty degrees with an upper edge of the game piece. The lines may each have a similar thickness (e.g., about 0.25 inch). The lines may be colored differently than the base color of the associated game piece, such that the lines will stand out. For instance, the lines may be white or may be colored some other color distinct form the base color of the associated game piece. As will be described in more detail below, the X-shaped lines of the teutonic knight (comprised of a pair of diagonal lines) may be indicative of the game piece's ability to move diagonally about the cells of the game board 12.

FIG. 3*c* illustrates a game piece in the form of a byzantine knight. The byzantine knight may include indicia/markings on a front surface (i.e., on a front surface shield) in the form of three intersecting, non-perpendicular lines shaped as a wheel spoke (or a six-spoked star). Specifically, a first of the three lines may be a horizontal line that extends generally parallel with an upper edge of the game piece. Each of the remaining two lines may extend from the upper edge of the game piece and intersect (with each other and with the horizontal line) near a center of the game piece. In some embodiments, each of the lines may intersect with each other so as to form an angle $\theta$ of approximately sixty degrees with each other. The lines may have each have a similar thickness (e.g., about 0.125 inch). The lines may be colored differently than the base color of the associated game piece, such that the lines will stand out. For instance, the lines may be white or may be colored some other color distinct form the base color of the associated game piece. As will be described in more detail below, the wheel spoke-shaped lines of the byzantine knight (comprised of three intersecting lines forming the shape of wheel spokes or a six-spoked star) may be indicative of the game piece's ability to move along spokes between cells of the game board 12, as will be described in more detail below.

FIG. 3*d* illustrates a game piece in the form of an excalibur knight. The excalibur knight may include indicia/markings on a front surface (i.e., on a front surface of the shield) in the form of four intersecting lines that comprise a combination of the lines included on the templar knight (i.e., FIG. 3*a*) and the teutonic knight (i.e., FIG. 3*b*). Specifically, the excalibur knight may include two intersecting, perpendicular lines in the form of a cross. The two lines may include a horizontal line that extends generally parallel with an upper edge of the game piece and a vertical line that extends orthogonal to the horizontal line. The horizontal line and the vertical line may intersect near a center of the game piece. The horizontal line may have a thickness (e.g., about 0.125 inch) that is thinner than a thickness of the vertical line (e.g., about 0.25 inch). In addition, the excalibur knight may include two intersecting, non-perpendicular lines in the form of an "X." Specifically, each of the two lines may extend from opposite upper corners of the game piece and intersect near a center of the game piece. In some embodiments, each of the two lines may form an angle α of approximately thirty degrees with a top edge of the game piece. The X-shaped lines may have each have a similar thickness (e.g., about 0.25 inch). Each of the four lines of the excalibur knight may intersect at near a center of the game piece. The lines may be colored differently than the base color of the associated game piece, such that the lines will stand out. For instance, the lines may be white or may be colored some other color distinct form the base color of the associated game piece. As will be described in more detail below, the combination of the cross-shaped and the X-shaped lines of the excalibur knight may be indicative of the game piece's ability to move vertically, horizontally, and diagonally about the cells of the game board 12 (i.e., having a movement ability that is a combination of the templar and teutonic knight).

FIG. 3*e* illustrates a game piece in the form of a guard. The guard may include various types of indicia/markings on a front surface (i.e., on a front surface of the shield), such as rectangular or pie-shaped pieces. However, in other embodiments, the guard may not have any indicia/markings, such that the shield of the game piece is a solid color of the base color. As will be described in more detail below, the guard may have a fairly restrictive movement ability, such as moving to one adjacent cell of the game board 12 per turn.

FIG. 3*f* illustrates a game piece in the form of a queen. The queen may include various types of indicia/markings on a front surface (i.e., on a front surface of the shield), such as an illustration of a female lion. The queen may also include the same four intersecting lines as are included on the excalibur knight (i.e., combination of the cross-shaped and the X-shaped lines). The lines may be colored differently than the base color of the associated game piece, such that the lines will stand out. For instance, the lines may be white or may be colored some other color distinct form the base color of the associated game piece. As will be described in more detail below, the combination of the cross-shaped and the X-shaped lines of the queen may be indicative of the game piece's ability to move vertically, horizontally, and diagonally about the cells of the game board 12.

FIG. 3*g* illustrates a game piece in the form of a king. The king may include various types of indicia/markings on a front surface (i.e., on a front surface of the shield), such as an illustration of a male lion. The king may also include the same four intersecting lines as are included on the excalibur knight (i.e., combination of the cross-shaped and the X-shaped lines). The lines may be colored differently than the base color of the associated game piece, such that the lines will stand out. For instance, the lines may be white or may be colored some other color distinct form the base color of the associated game piece. As will be described in more detail below, the combination of the cross-shaped and the X-shaped lines of the king may be indicative of the game piece's ability to move vertically, horizontally, and diagonally about the cells of the game board 12.

Figure 4:
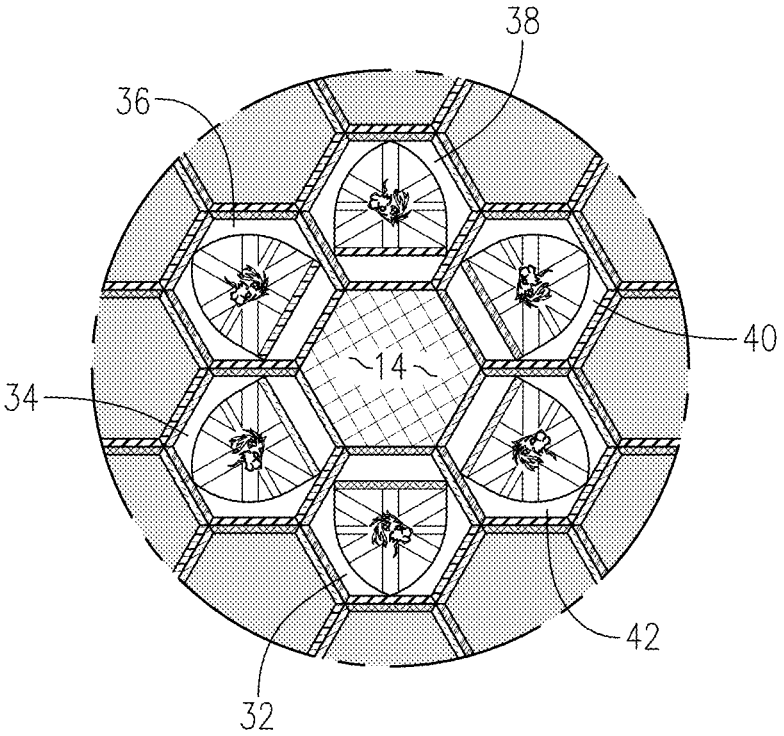
FIG. 4 is a partial view of a game board according to embodiments of the present invention, particularly illustrating a central cell and an inner ring of cells, occupied by game pieces, surrounding the central cell, with the inner ring of cells including orientation markers at the edges of each occupied cell to aid in properly orientating each game piece positioned within the cells of the inner ring.

Before the movement abilities of the game pieces about the game board 12 is described in more detail, it should be understood that the game pieces should be maintained in a proper orientation during the entirety of the game play. Such proper orientation will permit the game pieces to consistently perform legal maneuvers across the cells of the game board 12 during game play. As used, herein, the term "legal maneuvers" refers to a game piece movement during a player's turn that is allowed under valid rules of the game described herein. FIG. 4 illustrates an enlarged portion of the game board 12, with six game pieces (i.e., six kings), each being positioned in one of the cells of the inner ring that surround the central cell 14. Notably, each of the game pieces is properly oriented within its cell. In more detail, in some embodiments, each cell of the game board 12 will include "orientation markers" that indicate the proper orientation for each of the game pieces that may be positioned within the cell. Specifically, each of the six sides of each of the cells of the game board may be highlighted with a color (or other marking/indicia) that corresponds with the base color of one of the kingdoms and/or of the base color one of the sets of game pieces. The orientation markers may each comprise a colored line or a rectangular bar that extends along the interior of one of the sides of the associated cell. When a game piece is positioned within a cell, a proper orientation of the game piece within the cell is achieved when the upper edge of the game piece is aligned with (e.g., parallel with) the orientation marker that is the same color as the base color of the game piece.

For example, beginning with the lower most game piece shown in cell 32 of FIG. 4, the game piece is properly orientated withing the cell 32 because the upper edge of the game piece is aligned (e.g., parallel) with the orientation marker that is the same color (as indicated by the equivalent cross hatching of the upper edge of the game piece and of the orientation marker). It is noted that although FIG. 4 only illustrates the upper edges of the game pieces having unique base colors (as indicated by the cross hatching), the entire front surface of the game pieces (other than the markings indicative of the king) may be colored with the base color. Turning clockwise to cell 34, the game piece is properly orientated with the cell 34 because the upper edge of the game piece is aligned (e.g., parallel) with the orientation marker that is the same color (as indicated by the equivalent cross hatching and/or surface shading of the upper edge of the game piece and of the orientation marker). Similarly, the game pieces in each of cells 36, 38, 40, and 42 are all properly orientated within their respective cells 36, 38, 40, and 42 because the upper edges of the game pieces are aligned (e.g., parallel) with the orientation markers that are the same color as the game pieces (as indicated by the equivalent cross hatching and/or surface shading of the upper edges of the game pieces and of the orientation markers).

In general, the position of the orientation markers will be consistent for each of the cells of the game board 12. For example, when viewing FIG. 4 in an upright position (i.e., from the perspective of the player that has a king in cell 32, or stated differently, with cell 32 at the bottom and cell 38 at the top), the orientation marker that matches the base color of the game piece positioned within cell 32 is located at the top of the cell 32. Similarly, the same orientation marker is positioned at the top of each of the other cells illustrated in FIG. 4 (when viewing FIG. 4 from the upright position). As a result, regardless of which cell the game piece (currently positioned within cell 32) is moved, the proper orientation of the game piece will remain the same. In contrast, the proper orientation of the other pieces is rotated or shifted in an angular manner from the game piece positioned within cell 32. For example, when viewing FIG. 4 in an upright position (i.e., with cell 32 at the bottom and cell 38 at the top), the orientation marker that matches the base color of the game piece positioned within cell 38 is located at the bottom of the cell 38. Similarly, the same orientation marker is positioned at the bottom of each of the other cells illustrated in FIG. 4 (when viewing FIG. 4 from the upright position). As a result, regardless of which cell the game piece (currently positioned within cell 38) is moved, the proper orientation of the game piece will remain the same.

Figure 5:
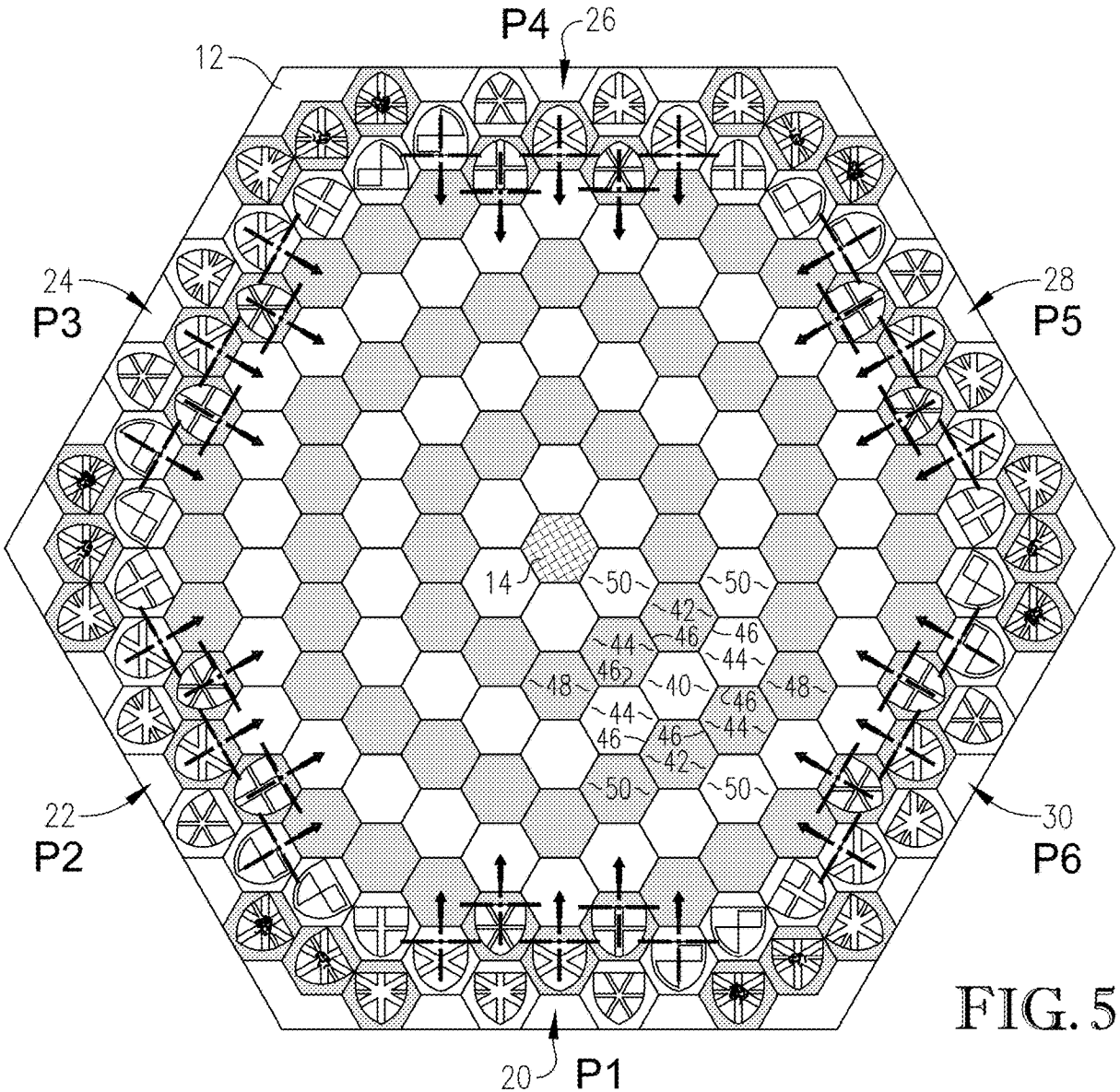
FIG. 5 is a top plan view of the game board system from FIG. 1, particularly illustrating proper orientation of the game pieces within kingdom cells of the game board.

Such proper orientation is further illustrated in FIG. 5. A first player P1 playing the game is positioned behind the first kingdom 20 and a first set of game pieces associated with the first kingdom 20 (the first kingdom 20 and the first set of game pieces are all highlighted with the same unique base color, e.g., purple). As the first player P1 plays the game, the first player P1 is assigned the first kingdom 20 and is responsible for moving the game pieces from the first set of game pieces. Correspondingly, a second player P2, a third player P3, a fourth player P4, a fifth player P5, and a sixth player P6 are positioned, respectively, behind the second kingdom 22 and a second set of game pieces associated with the second kingdom 22 (the second kingdom 22 and the second set of game pieces are all highlighted with the same unique base color, e.g., yellow), the third kingdom 24 and a third set of game pieces associated with the third kingdom 24 (the third kingdom 24 and the third set of game pieces are all highlighted with the same unique base color, e.g., red), the fourth kingdom 26 and a fourth set of game pieces associated with the fourth kingdom 26 (the fourth kingdom 26 and the fourth set of game pieces are all highlighted with the same unique base color, e.g., green), the fifth kingdom 28 and a fifth set of game pieces associated with the fifth kingdom 28 (the fifth kingdom 28 and the fifth set of game pieces are all highlighted with the same unique base color, e.g., black), and the sixth kingdom 30 and a sixth set of game pieces associated with the sixth kingdom 30 (the sixth kingdom 30 and the sixth set of game pieces are all highlighted with the same unique base color, e.g., blue).

Remaining with FIG. 5, embodiments of the game playing process may require each of the sets of game pieces to remain oriented in the proper orientation regardless of which cell of the game board 12 the game pieces are positioned. For example, directional cross-hairs are shown drawn on certain of the game pieces from each of the six sets of game pieces. Each of the cross-hairs includes an arrow that is angled perpendicular to an upper edge of the game piece with which the cross hair is associated (it is noted that these arrows do not indicate the legal movements of the respective pieces). For instance, the cross-hair arrows associated with the first set of game pieces of the first kingdom 20 are each oriented so as to be directed vertically upward (when viewed from the position of the first player P1). Regardless of which cell of the game board 12 any of the first set of game pieces are located, the first set of game pieces should be properly oriented with the cross-hair arrow pointed vertically upward (when viewed from the position of the first player P1). Such proper orientation can be easily maintained by observing the orientation markers in each cell and ensuring that the orientation marker that corresponds with the base color of a game pieces is aligned with the upper edge of the game piece. Although FIG. 5 does not illustrate the orientation markers positioned within the cells of the game board 12, such orientation marker are illustrated in more detail in FIG. 4, as previously discussed.

Correspondingly, when viewing the game board 12 from the position of the first player P1, each of the game pieces of the second set of game pieces of the second kingdom 22 (being played by the second player P2) should be properly oriented such that the game piece cross-hair arrow is directed rightward and upward regardless of the cell in which the game piece is positioned. Also, when viewing the game board 12 from the position of the first player P1, each of the game pieces of the third set of game pieces of the third kingdom 24 (being played by the third player P3) should be properly oriented such that the game piece cross-hair arrow is directed rightward and downward regardless of the cell in which the game piece is positioned. When viewing the game board 12 from the position of the first player P1, each of the game pieces of the fourth set of game pieces of the fourth kingdom 26 (being played by the fourth player P4) should be properly oriented such that the game piece cross-hair arrow is directed vertically downward regardless of the cell in which the game piece is positioned. When viewing the game board 12 from the position of the first player P1, each of the game pieces of the fifth set of game pieces of the fifth kingdom 28 (being played by the fifth player P5) should be properly oriented such that the game piece cross-hair arrow is directed leftward and downward regardless of the cell in which the game piece is positioned. Finally, when viewing the game board 12 from the position of the first player P1, each of the game pieces of the sixth set of game pieces of the sixth kingdom 30 (being played by the sixth player P6) should be properly oriented such that the game piece cross-hair arrow is directed leftward and upward regardless of the cell in which the game piece is positioned. As described previously, embodiments of the present invention provides for efficient maintaining of proper orientation of the game pieces via use of the orientation markers included in each of the cells of the game board 12, as shown in FIG. 4.

Before turning to examples of legal maneuvers of the game pieces, a brief description of the cells of the game board 12 will be provided. FIG. 5 illustrates a cell 40 of the game board 12. The cell 40 is a battlefield cell, as it is positioned between the kingdom cells and the central cell 14. Although cell 40 is discussed below as an example, the remaining cells of the game board may include the same features described below with respect to cell 40. Because the cell 40 (as with all of the playable cells of the game board 12) is hexagonal, the cell 40 includes six sides. Cells immediately adjacent to the cell 40 (i.e., connected by one of the six sides of the cell 40) include (i) cells 42 positioned vertically above and below the cell 40, and (ii) cells 44 positioned diagonally (leftward/downward, leftward/upward, rightward/upward, rightward/downward) with respect to the cell 40. In addition, the cell 40 includes six spokes 46, each extending from one of the six the corners of the hexagonally-shaped cell 40. Two of the spokes 46 extend horizontally from the cell 40 to horizontally-adjacent cells 48. The remaining four spokes extend obliquely from the cell 40 at roughly forty-five degree angles to obliquely-adjacent cells 50. It should be noted that the spokes 46 extending from cell 40 form sides of other cells that are adjacent to the cell 40.

A game piece being positioned in the cell 40 may legally maneuver to one or more of the adjacent cells 42, 44, 48, or 50 (depending on the type of game piece). For instance, a game piece may move vertically upward or downward to adjacent cells 42 (as well as other cells further spaced vertically upward or downward from the cell 40). Alternatively, a game piece may move horizontally leftward or rightward across horizontal spokes 46 to adjacent cells 48 (as well as other cells further spaced horizontally leftward or rightward from the cell 40). A game piece may move diagonally (leftward/downward, leftward/upward, rightward/upward, rightward/downward) to adjacent cells 44 (as well as other cells further spaced diagonally (leftward/downward, leftward/upward, rightward/upward, rightward/downward) from the cell 40). Furthermore, a game piece may move obliquely (leftward/downward, leftward/upward, rightward/upward, rightward/downward) across oblique spokes 46 to adjacent cells 50 (as well as other cells further spaced obliquely (leftward/downward, leftward/upward, rightward/upward, rightward/downward) from the cell 40).

Figure 6:
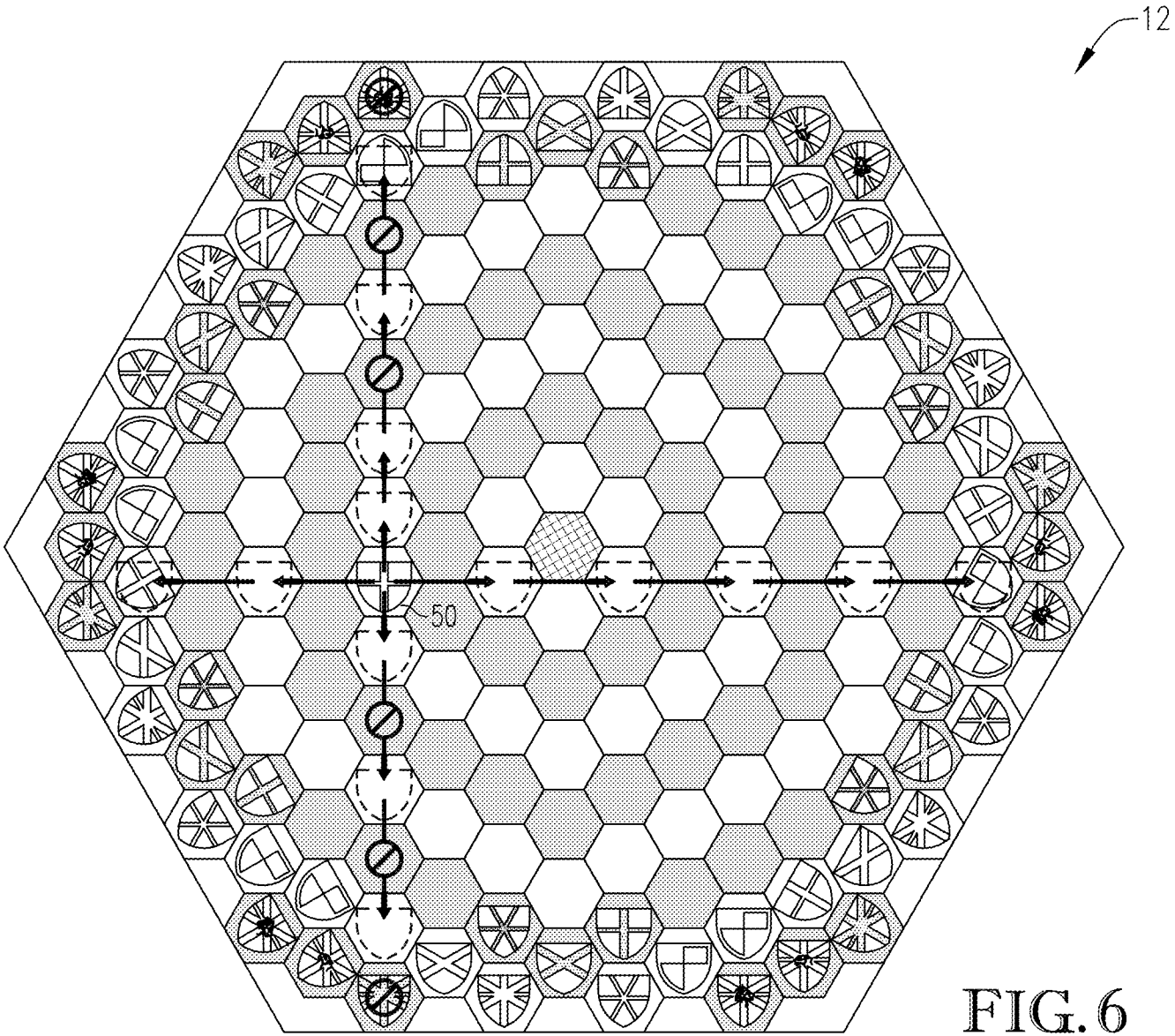
FIG. 6 is a top plan view of the game board system from FIG. 1, schematically illustrating legal maneuvers for the templar knight from FIG. 3*a* that may only occupy light aspect cells.

FIG. 6 illustrates a templar knight positioned within a cell 50 of the game board 12. As indicated by the cross-shaped markings on the templar knight (i.e., the horizontal and vertical lines), the legal maneuvers for the templar knight are horizontal and vertical moves. For instance, the templar knight may move to any of the cells of the game board 12 that are vertically above or below the cell 50. However, it should be noted that, in some embodiments, none of the game pieces described herein is permitted to move beyond another game piece that is blocking the path of the moving game piece. Notwithstanding the above, and as will be discussed in more detail below, a first game piece can capture a second game piece that is blocking the movement of the first game piece if the first game piece ends its legal maneuver by landing on the cell occupied by the second game piece.

Returning to FIG. 6, as was discussed previously, in some embodiments certain of the cells of the game board are shaded white or dark. Furthermore, certain of the game pieces have edges that are shaded white or dark. In such embodiments, the game pieces with edges that are shaded white may only be permitted to end a legal maneuver by landing on cells that are similarly shaded white. Likewise, the game pieces with edges that are shaded dark may only be permitted to end a legal maneuver by landing on cells that are similarly shaded dark. The templar knight shown in FIG. 6, has an edge that is shaded white. As such, the templar knight is only permitted to be moved vertically upward or downward from the cell 50 and end such movement on another cell that is shaded white. In addition, the templar knight is permitted to move horizontally from the cell 50 (about the horizontal spokes emanating from the cell 50, as well as other horizontal spokes in line with the horizontal spokes emanating from the cell 50) and end such movement on another cell that is shaded white. Because of the arrangement of the hexagonal cells of the game board, the templar knight must travel from the cell 50 across one or more horizontal spokes to reach cells that are horizontally leftward or rightward of the cell 50.

Figure 7:
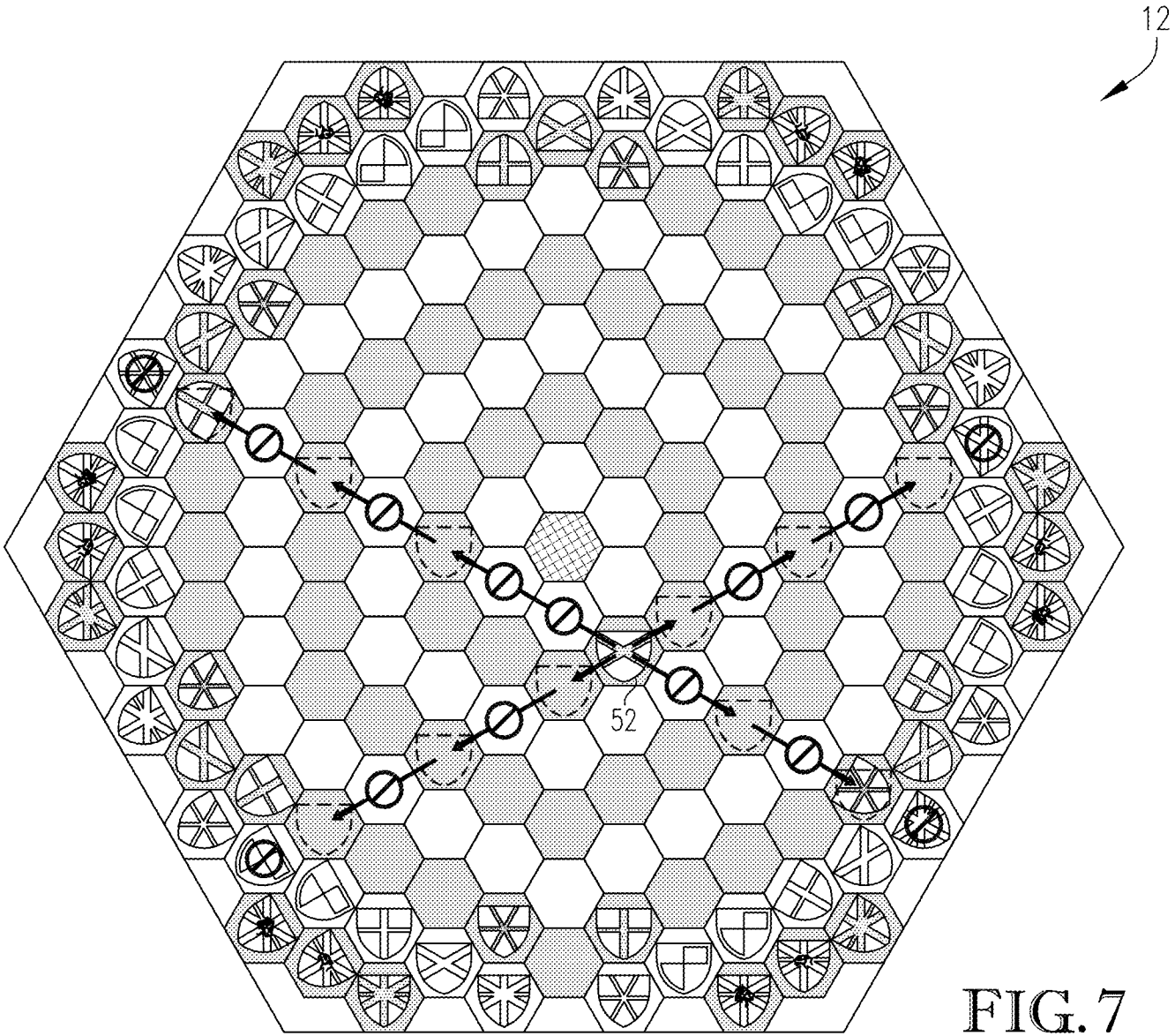
FIG. 7 is a top plan view of the game board system from FIG. 1, schematically illustrating legal maneuvers for the teutonic knight from FIG. 3*b* that may only occupy dark aspect cells.

FIG. 7 illustrates a teutonic knight positioned within a cell 52 of the game board 12. As indicated by the X-shaped markings on the teutonic knight (i.e., the pair of diagonal lines), the legal maneuvers for the teutonic knight are diagonal moves. For instance, the teutonic knight may move to any of the cells of the game board 12 that are diagonally leftward/downward, leftward/upward, rightward/upward, rightward/downward the cell 52. Notably, such diagonal cells do not require the teutonic knight to travel over spokes extending from the cell 52. Furthermore, the teutonic knight shown in FIG. 7, has an edge that is shaded dark. As such, the teutonic knight is only permitted to move diagonally from the cell 52 and end a legal maneuver by landing on another cell that is shaded dark.

Figure 8:
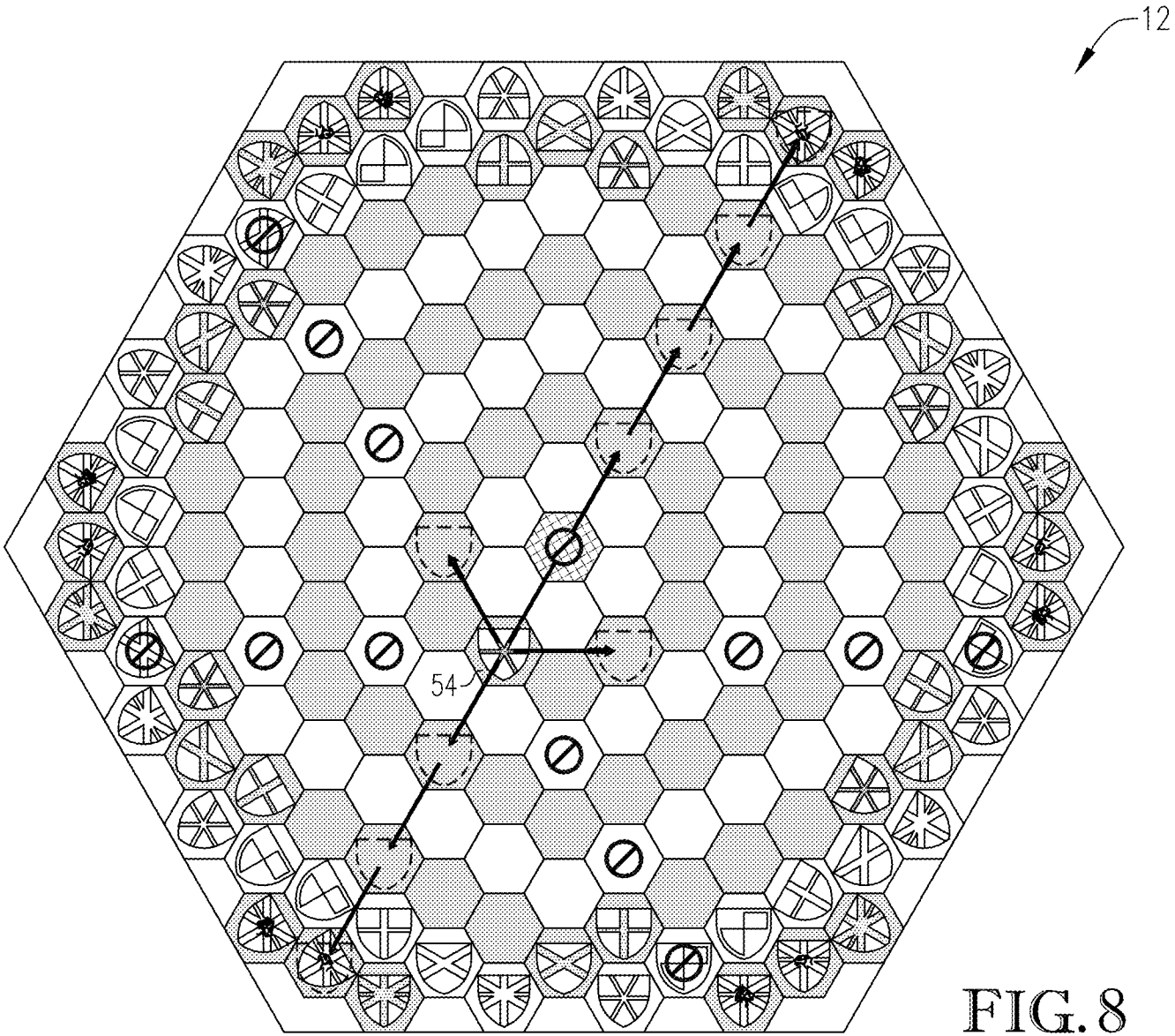
FIG. 8 is a top plan view of the game board system from FIG. 1, schematically illustrating legal maneuvers for the byzantine knight from FIG. 3*c* that may only occupy dark aspect cells.

FIG. 8 illustrates a byzantine knight positioned within a cell 54 of the game board 12. As indicated by the wheel spoke-shaped markings on the byzantine knight (i.e., the horizontal line and two oblique lines), the legal maneuvers for the byzantine knight are horizontal and oblique moves along the spokes of the cell 54 (as well as along other spokes in line with the spokes of the cell 54). For instance, the byzantine knight may move horizontally leftward or rightward from the cell 54 (about the horizontal spokes emanating from the cell 54, as well as other horizontal spokes in line with the horizontal spokes emanating from the cell 54). In addition, the byzantine knight may move to any of the cells of the game board 12 that are obliquely leftward/downward, leftward/upward, rightward/upward, rightward/downward from the cell 54 (about the oblique spokes emanating from the cell 54, as well as other oblique spokes in line with the oblique spokes emanating from the cell 54). Furthermore, however, the byzantine knight shown in FIG. 8, has an edge that is shaded dark. As such, the byzantine knight is only permitted to be moved horizontally and obliquely (across the spokes) from the cell 54 and end such legal maneuver by landing on another cell that is shaded dark.

Figure 9:
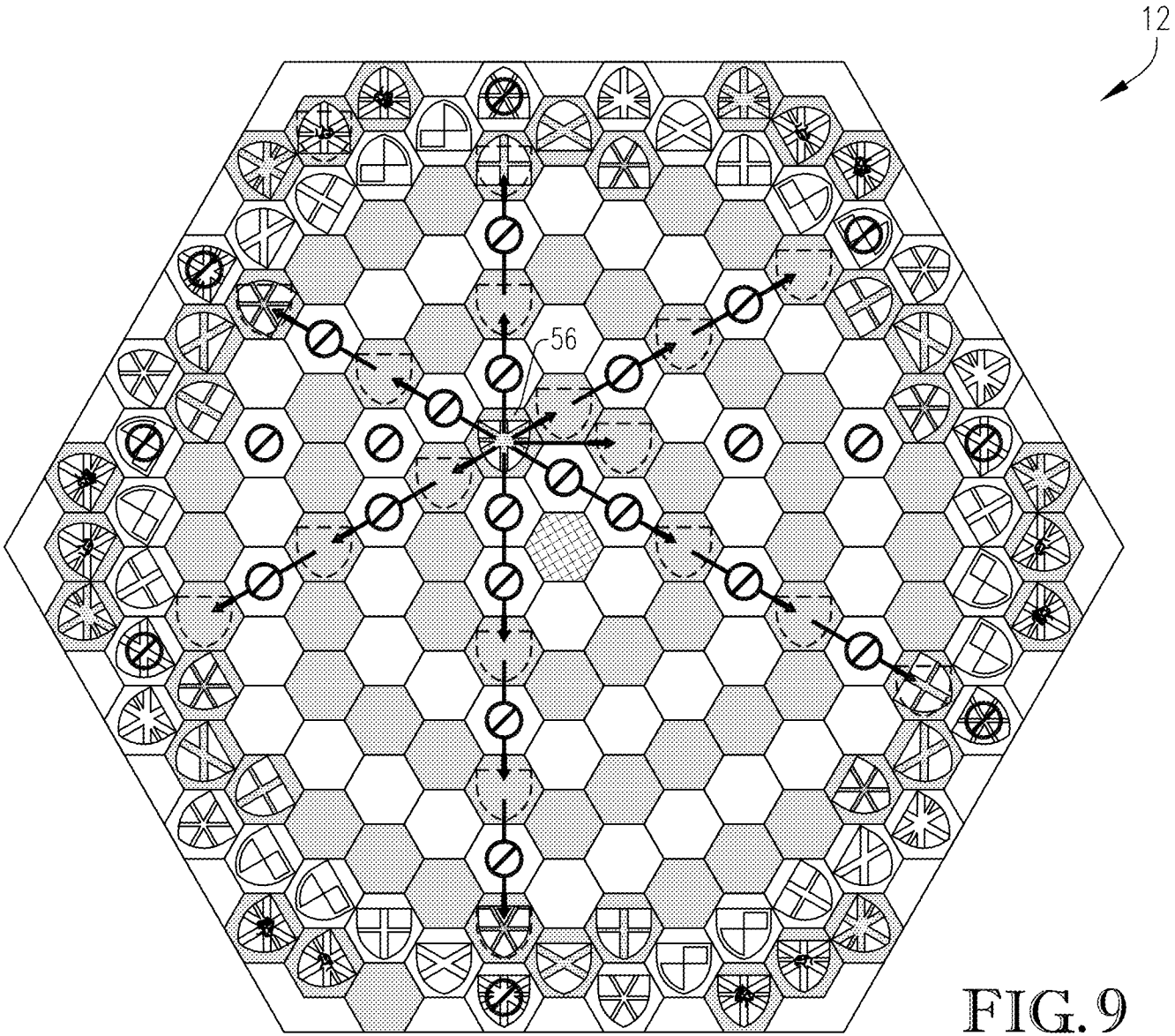
FIG. 9 is a top plan view of the game board system from FIG. 1, schematically illustrating legal maneuvers for the excalibur knight from FIG. 3*d* that may only occupy dark aspect cells.

FIG. 9 illustrates an excalibur knight positioned within a cell 56 of the game board 12. As indicated by the combination of the cross-shaped markings and the X-shaped markings on the excalibur knight, the legal maneuvers for the excalibur knight are ae combination of the templar knight and the teutonic knight, namely, vertical, horizontal, and diagonal moves. For instance, the excalibur knight may move to any of the cells of the game board 12 that are vertically above or below the cell 56. In addition, the excalibur knight may move to any of the cells of the game board 12 that are horizontally leftward or rightward from the cell 56 (along the horizontal spokes that emanate from the cell 56). Furthermore, the excalibur knight is permitted move to any of the cells of the game board 12 that are diagonally leftward/downward, leftward/upward, rightward/upward, rightward/downward the cell 56. Notably, such diagonal cells do not require the excalibur knight to travel over spokes extending from the cell 56. Furthermore, however, the excalibur knight shown in FIG. 9, has an edge that is shaded dark. As such, the excalibur knight is only permitted to be moved vertically, horizontally, or diagonally from the cell 56 and end such legal maneuver by landing on another cell that is shaded dark.

As was described previously, the king and queen game pieces can perform legal maneuvers movement that correspond with those of the excalibur knight. Such maneuvers correspond with the cross-shaped and X-shaped markings on the king and queen pieces. Unlike the excalibur knights, however, the king and queen game pieces can move to any cell on the game board 12, regardless of whether the cell is white or dark. However, in some embodiments, the queen may only be permitted to move within the kingdom cells of the home kingdom with which the queen is associated. Stated differently, the queen may not be permitted to move to the battlefield cells, to the central cells, or to the kingdom cells of another kingdom (e.g., an opposing player's kingdom).

Finally, the guard game pieces may also perform legal maneuvers movement that correspond with those of the excalibur knight. As with the king and queen game pieces, the guard game pieces can move to any cell on the game board 12, regardless of whether the cell is white or dark. However, in some embodiments, the guards may only be permitted to move once cell per turn.

In view of the above, a game may be played using the system 10, which includes the game board 12 and a plurality of sets of game pieces. In some embodiments, six players will preferably play the game. However, it is contemplated that any number of two or more players may play the game (e.g., two, three, four, five, or six). In situations in which more than six players wish to the play the game, two or more players may each be assigned to a team (e.g., multiple players are assigned to a kingdom and an associated set of game pieces).

In situations in which six players are playing the game, each player will be assigned a kingdom and a set of twelve game pieces. As was described above, each of the six kingdoms and corresponding set of game pieces will have their own base color (e.g., purple, yellow, red, green, black, and blue). Each set of game pieces will include a two templar knights (one with a white edge and one with a dark edge), two teutonic knights (one with a white edge and one with a dark edge), two byzantine knights (one with a white edge and one with a dark edge), two excalibur knights (one with a white edge and one with a dark edge), two guards, one queen, and one king. The game pieces may be arranged within the cells of their associated kingdom in various configurations. However, in some embodiments, they may be arranged within the cells of their associated kingdom in the manner illustrated in FIGS. 1 and 5.

With six players, a game will begin by a first player executing a turn by making a legal maneuver with one of the first player's game pieces. Subsequently, a second player (positioned clockwise from the first player) will execute a turn by making a legal maneuver with one of the second player's game pieces. Such action will continue until all six players have executed a turn; at which time the first player will then execute a second turn by making a second legal maneuver with one of the first player's game pieces. The game will finish when one player achieves the process of moving their king one compete revolution (e.g., 360 degrees) around the game board 12 and enters the central cell 14. In some embodiments of the game, the king of the winning player will only be able to enter the central cell 14 through a side (one of the six sides of the hexagonally-shaped central cell 14) that is adjacent to the orientation marker corresponding with the base color of the kingdom of the winning player. For example, referring to FIG. 4, if the winning player is associated with the kingdom and the game pieces that have the same base color as the game piece positioned within cell 32 (e.g., the base color illustrated by the "xxxxx" cross hatching), then the winning player's king would only be able to enter the central cell 14 via cell 32 because the orientation marker of cell 32 that is adjacent to the central cell 14 corresponds with the base color of the winning player's kingdom and the game pieces (i.e., illustrated via the "xxxxx" cross hatching). Such a requirement helps to ensure that the winning player's king will make at least one compete revolution around the game board 12 before entering the central cell 14 and winning the game.

Returning to the game play before a player has won the game (i.e., by the winning player's king entering the central cell 14, as discussed above), each of the players will execute an individual turn, one after the other in a clockwise manner. In general, each turn by a player will comprise a single, legal maneuver by one of such player's game pieces. For example, during a player's turn, the player may make a single, legal maneuver by one of the player's knights (e.g., one of the templar, teutonic, byzantine, or excalibur knights) or guards. Alternatively, if the player chooses to move the player's queen or king, the player will be permitted to perform two consecutive moves by the queen or king.

Furthermore, however, if during a turn a player is able to capture an opponent's game piece (e.g., by ending by a legal maneuver by landing on a cell in which the opponent's game piece is positioned), the player will be permitted to perform an additional legal maneuver before finishing the turn. Before discussing the applicability of additional legal maneuvers during a player's turn, it is noted that in some embodiments, the game board 12 will include one or more sanctuary cells 60, as illustrated in FIG. 2. For instance, the game board 12 may include three white sanctuary cells 60 and three dark sanctuary cells 60. Such sanctuary cells 60 may be identified by markings/indicia in the form of a plurality of intersecting diagonal lines extending through the cells 60. Should a player maneuver one of the player's game pieces to a sanctuary cell 60, the player's game piece is safe from capture by other players during the subsequent round of turns.

For example, if a player is able to capture an opponent's game piece using one of the player's knights, the player will be provided with the ability to use a second, additional legal maneuver during the player's turn. The player may be able to use the additional legal maneuver by the knight that made the capture if the knight can legally maneuver to one of the sanctuary cells 60. If the player cannot legally maneuver the knight that made the capture to one of the sanctuary cells 60, the knight that made the capture must make an additional legal maneuver.

If a player is able to capture an opponent's game piece using one of the player's guards, king, or queen, the player must use the additional legal maneuver using the guard, king, or queen that made the capture. It is noted that neither the guard, the king, nor the queen are permitted to reside within the sanctuary cells 60. It is further noted that in some embodiments, as discussed above, that the queen must remain within her home kingdom (i.e., the kingdom with which the queen is associated and with which she shares the same base color) at all times during game play. Furthermore, it is noted that the king and the queen are normally allowed to perform two consecutive legal maneuvers during a turn. Regardless, the king and queen are only permitted to perform one additional legal maneuver if they are able to capture either one or two opponent game pieces during such two initial legal maneuvers.

It should be noted, as briefly mentioned above, that a player may capture an opponent's game piece by ending a legal maneuver of the player's game piece by landing on a cell in which an opponent's game piece is located. Upon capture, the opponents game piece is removed from the game board 12 and is no longer in play. In some embodiments, each of the knight game pieces (e.g., each of the templar, teutonic, byzantine, or excalibur knights) may be promoted to a royal status if such game piece is able to capture at least two game pieces from one or more opponents. A royal status may be indicated by a royalty marking/indicia, such as lion's head, located on a reverse surface of the game piece. As such, once a knight game piece has achieved royal status, the game piece may be flipped over to review the royalty marking/indicia and continue to play as royal status for the remainder of the game. Notably, once a game piece has achieved royal status, the game piece is permitted to perform two consecutive legal maneuvers during each turn of the player controlling the game piece. As with the king and queen, a knight that has achieved royal status is only permitted to perform one additional move if it is able to capture either one or two opponent game pieces during the two initial legal maneuvers performed by the knight. To aid in tracking whether a knight is qualified to obtain royal status, the system 10 may additionally include scorecards with which players can track how many captures each of their knights have made during game play.

In some embodiments of the game, a player may only win the game if (i) the player's king travels completely around the game board 12 and enters the central cell 14 (as was previously discussed), and (ii) the player's queen is not captured by an opponent when the player's king enters the central cell 14. If the player's queen has been captured by an opponent, the player may only recover the player's queen by the player capturing the opponent's king or queen, in which case a swap occurs, and each player's queen and/or king is returned. Similarly, if a player's king has been captured by an opponent, the player may only recover the player's king by the player capturing the opponent's king or queen, in which case a swap occurs, and each player's king and/or queen is returned.

Some games may take a significant amount of time to complete (e.g., 1-3 hours). Embodiments provide for an expedited game play to be performed. For example, a maximum game time may be established (e.g., 1 hour) for the game to be completed. During such an expedited game, each player may be permitted o maximum turn time (e.g., 1 minute) in which to complete the player's turn (e.g., by performing one or more legal maneuvers). The game ends when a player's king enters the central cell 14 (as previously discussed) or when the maximum game time expires. If the maximum game time expires, the player with the greatest number of points will be declared the winner. Points may be obtained by a player capturing opponents' game pieces. For example, each opponent's guard may be worth one point, each opponent's templar, teutonic, or byzantine knight may be worth two points, each opponent's excalibur knight may be worth three points, each opponent's royal templar, teutonic, or byzantine knight may be worth four points, each opponent's royal excalibur knight may be worth six points, each opponent's queen may be worth eight points, and each opponent's king may be worth ten points.

Figure 10A:
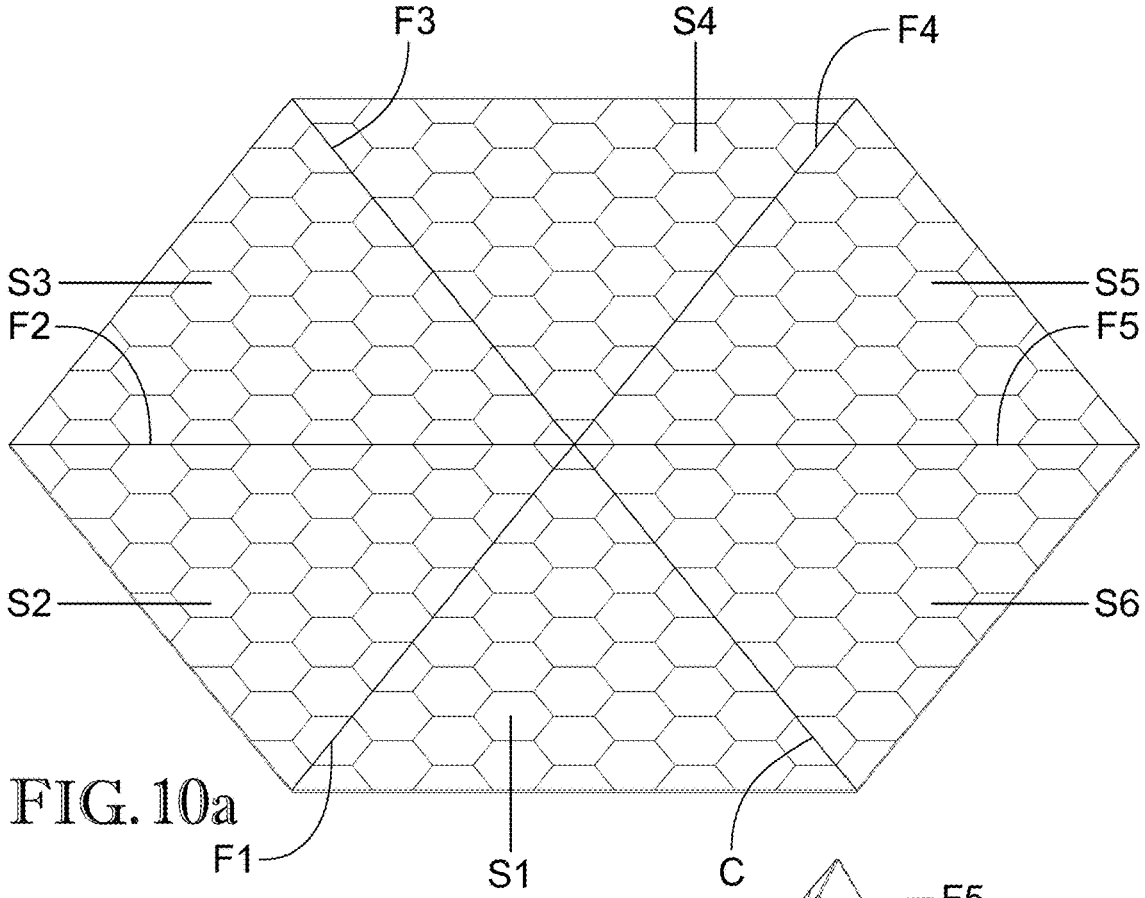
FIG. 10*a* is a perspective view of another game board according to embodiments of the present invention, with the game board in including a plurality of sections separated by folds and/or a cut, and the with the game board being in an expanded form.

Finally, embodiments of the present invention may provide for the game board 12 of the system 10 to be configured in a particular manner so as to be folded from an expanded form (in which the game is played) to a compact form (for easy travel and storage). For example, referring to FIG. 10*a*, the expanded game board may comprise a generally flat board. The game bard may comprise six triangular sections S1-S6. Each of the triangular sections S1-S6 may comprise generally equilateral triangles. Section S1 may be separated from section S2 by a fold, crease, or crimp F1 formed in the board. The fold F1 may extend from a center of the game board to one of the six perimeter corners of the hexagonal game board. Section S2 may be separated from section S3 by a fold, crease, or crimp F2 formed in the board. The fold F2 may extend from the center of the game board to one of the six perimeter corners of the hexagonal game board. Section S3 may be separated from section S4 by a fold, crease, or crimp F3 formed in the board. The fold F3 may extend from the center of the game board to one of the six perimeter corners of the hexagonal game board. Section S4 may be separated from section S5 by a fold, crease, or crimp F4 formed in the board. The fold F4 may extend from the center of the game board to one of the six perimeter corners of the hexagonal game board. Section S5 may be separated from section S6 by a fold, crease, or crimp F5 formed in the board. The fold F5 may extend from the center of the game board to one of the six perimeter corners of the hexagonal game board. Finally, section S6 may be separated from section S1 by a cut C formed in the board. The cut C may extend from the center of the game board to one of the six perimeter corners of the hexagonal game board.

Figure 10B:
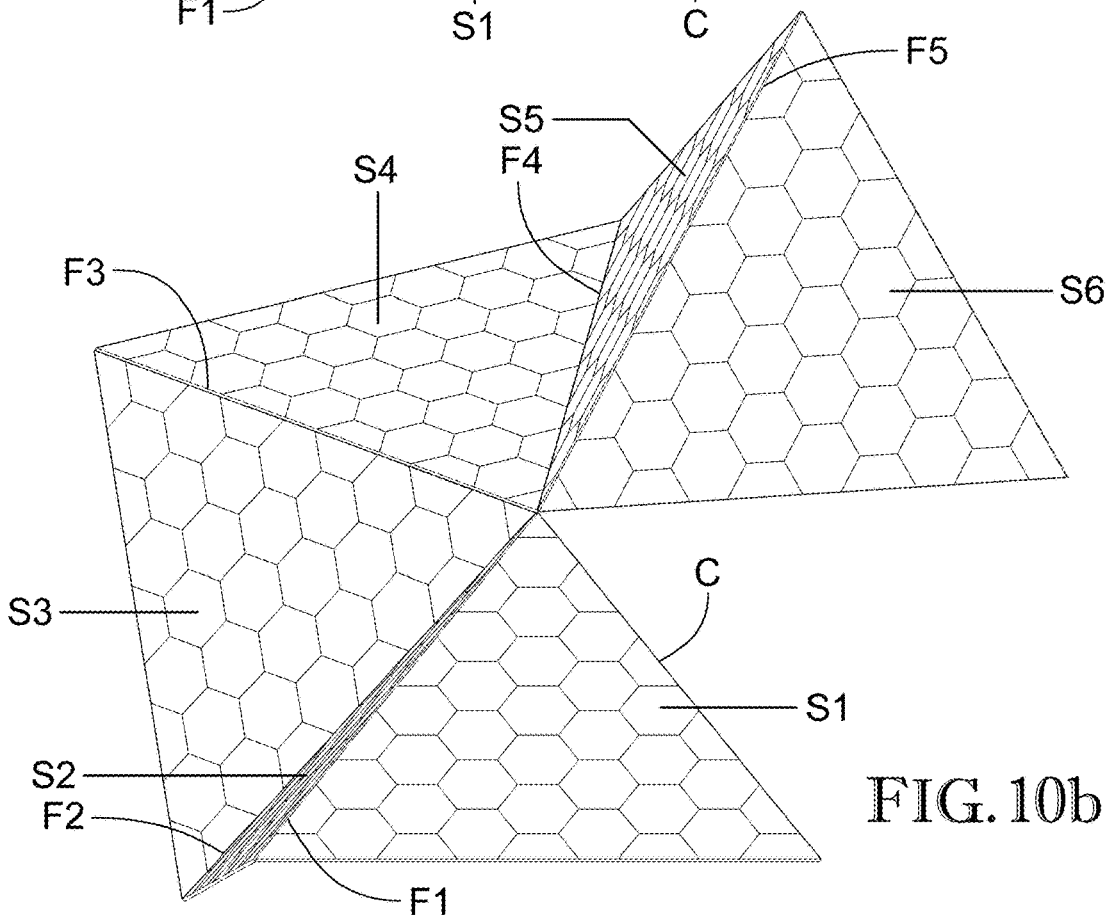
FIG. 10*b* is a perspective view of the game board from FIG. 10*a*, particularly illustrating the sections of the game board being folded about the folds.
Figure 10C:
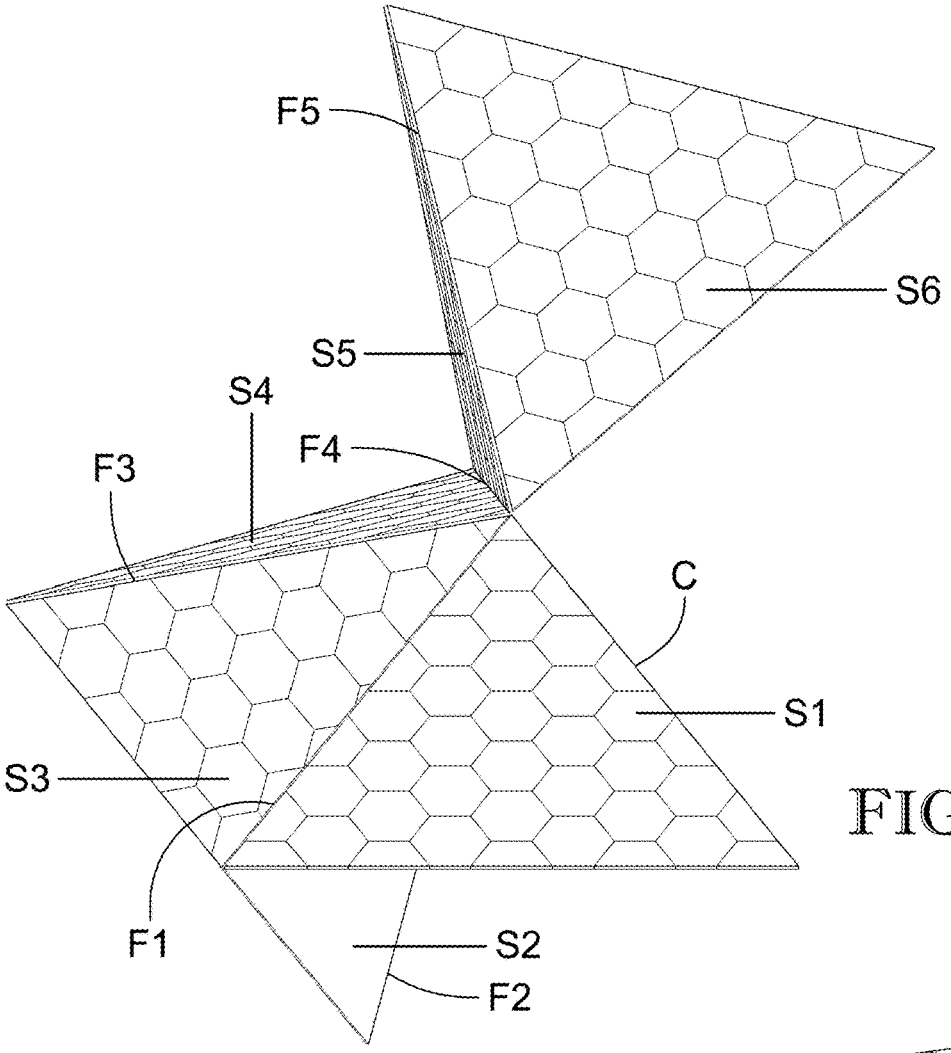
FIG. 10*c* is another perspective view of the game board from FIGS. 10*a* and 10*b*, further illustrating the sections of the game board being folded about the folds.
Figure 10D:
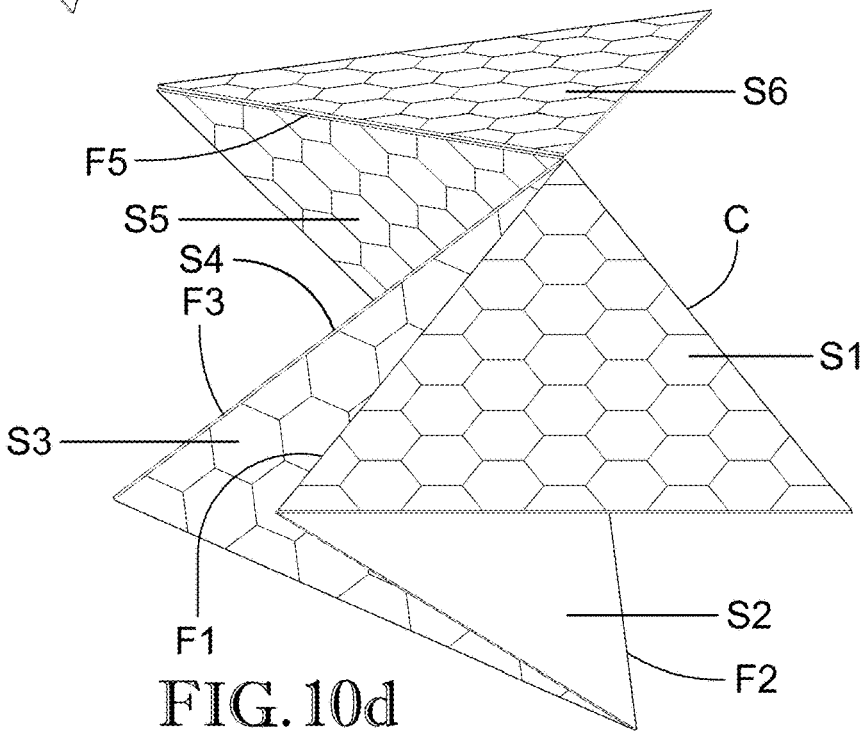
FIG. 10*d* is another perspective view of the game board from FIGS. 10*a*-10*c*, further illustrating the sections of the game board being folded about the folds.
Figure 10E:
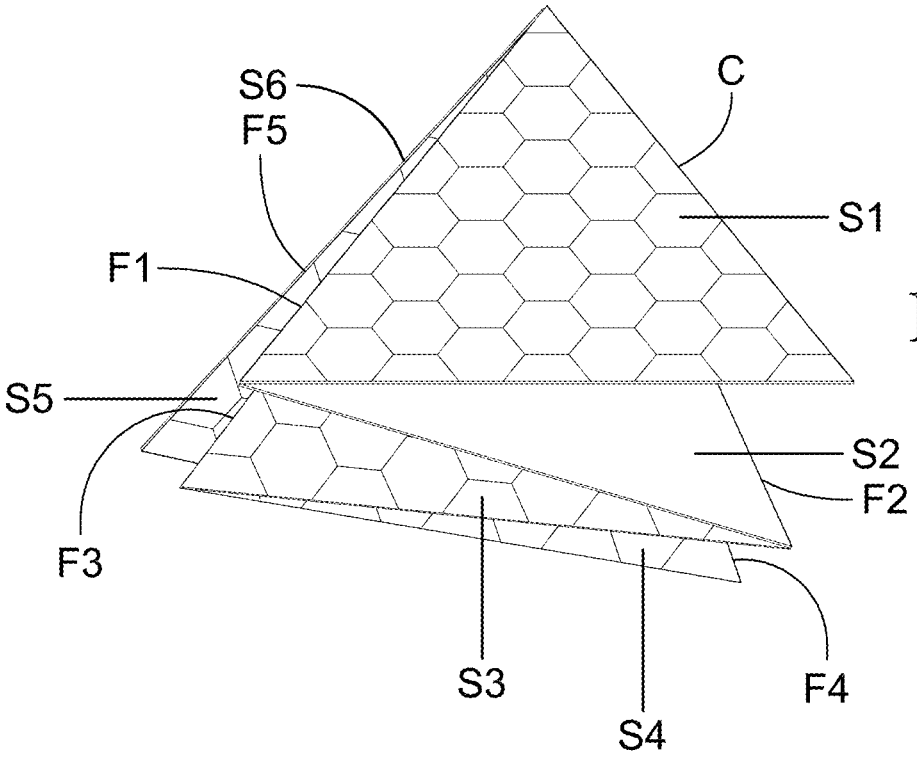
FIG. 10*e* is another perspective view of the game board from FIGS. 10*a*-10*d*, further illustrating the sections of the game board being folded about the folds.
Figure 10F:
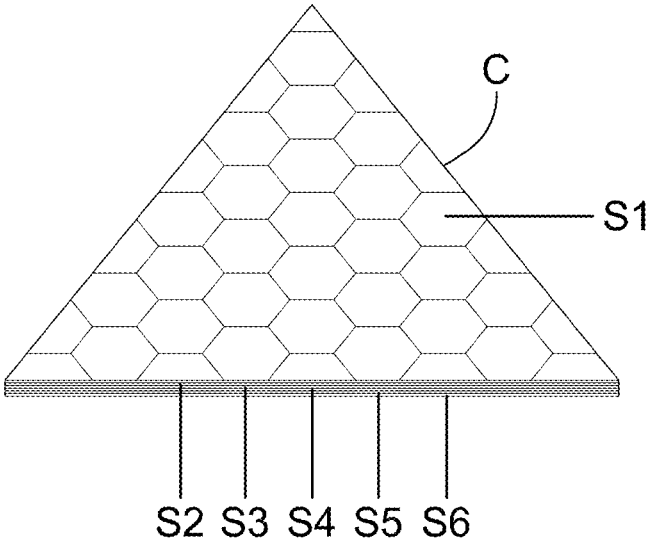
FIG. 10*f* is a further perspective view of the game board from FIGS. 10*a*-10*e*, illustrating the sections of the game board being completely folded such that the game board is in a compact form to aid in storage.

Beginning with FIG. 10*b* and continuing through FIG. 10*e*, the board may be folded from the expanded form to the compact form by performing the following steps. Section S6 is separated from section S1 along the cut C. The section S6 can then be folded underneath the section S5 along the fold F5. Section S5 (with section S6 folded underneath) can be folded on top of section S4 along the fold F4. The section S1 can be folded underneath the section S2 along the fold F1. Section S2 (with section S1 folded underneath) can be folded on top of section S3 along the fold F2. Finally, section S4 (with sections S5 and S6 folded on top) can be folded underneath section S3 (with sections S1 and S2 folded on top) along fold F3. The resulting configuration of the game board is illustrated in FIG. 10*f*, as each of the sections S1-S6 stacked one on top of the other to present the game board in a compact form that is shaped as a triangle.

Although the invention has been described with reference to the one or more embodiments illustrated in the figures, it is understood that equivalents may be employed, and substitutions made herein without departing from the scope of the invention as recited in the claims.

Having thus described one or more embodiments of the invention, what is claimed as new and desired to be protected by Letters Patent includes the following:

1. A method of playing a multi-player game, said method comprising the steps of:

(a) providing a hexagonal game board, wherein the game board comprises a plurality of hexagonal cells on a top surface of the game board, wherein the cells are separated into a plurality of kingdoms comprising kingdom cells, a plurality of battlefield cells, and a central cell, wherein each of the cells of the game board further includes a plurality of orientation markers extending along edges of the respective cell;

(b) providing a set of game pieces, wherein the set of game pieces is associated with one of the plurality of kingdoms, wherein each of the game pieces is shaped as a shield with a straight upper edge and a U-shaped lower edge, wherein each of the game pieces further comprises an orientation marker extending along the upper edge of the respective game piece;

(c) positioning a given game piece in a proper orientation within a given cell of the game board by aligning the orientation marker extending along the upper edge of the given game piece with the orientation marker of the given cell that corresponds with the orientation marker of the given game piece, wherein at least one of the game pieces from the set of game pieces includes an indicia on the at least one game piece, wherein the indicia is indicative of a legal maneuver permitted by said at least one game piece; and (d) moving the at least one game piece that includes the indicia about the cells of the game board according to the legal maneuver indicated by the indicia.

2. The method of claim 1, wherein the set of game pieces and the associated kingdom are both highlighted with a base color.

3. The method of claim 2, wherein a first portion of the cells of the game board are a first color and a second portion of the cells of said game board are a second color, wherein the at least one game piece is highlighted with the first color, and wherein during said moving of step (d), the legal maneuver includes the at least one game piece being positioned on the first portion of the cells of the game board.

4. The method of claim 1, wherein the set of game pieces includes a king game piece, and wherein the method further includes the step of winning the game by the king moving a complete rotation around the game board and entering the central cell.

5. The method of claim 4, wherein the set of game pieces includes a queen game piece, and wherein the game can only be won if the queen has not been captured by an opposing player.

6. The method of claim 1, wherein the at least one game piece is controlled by a first player playing the multi-player game, wherein the method further includes the step of moving the at least one game piece to a sanctuary cell, wherein upon the at least one game piece being situated in the sanctuary cell, the at least one game piece is safe from attack by game pieces controlled by other players of the multi-player game.

7. The method of claim 1, wherein the indicia comprises cross-shaped lines and includes a horizontal line and a vertical line, wherein the horizontal line and the vertical line intersect.

8. The method of claim 7, wherein the legal maneuver indicated by the cross-shaped indicia includes vertical or horizontal movements about the cells of the game board.

9. The method of claim 1, wherein the indicia comprises X-shaped lines and includes a pair of diagonal lines, wherein the diagonal lines intersect.

10. The method of claim 9, wherein the legal maneuver indicated by the X-shaped indicia includes diagonal movements about the cells of said game board.

11. The method of claim 1, wherein the indicia comprises wheel spoke-shaped lines and includes three intersecting lines, wherein the lines intersect with each other at equal angles.

12. The method of claim 11, wherein the legal maneuver indicated by the wheel spoke-shaped indicia includes oblique movements along spokes extending from the cells of said game board.

13. The method of claim 1, wherein the cells of said game board are arranged as concentric circles of alternating light colored cells and dark colored cells.

14. The method of claim 1, wherein the kingdoms are positioned around a perimeter of said game board.

15. The method of claim 14, wherein each kingdom is associated with a unique base color.

16. The method of claim 14, wherein the battlefield cells are located between the kingdoms and the central cell.

17. The method of claim 1, wherein each of the plurality of cells includes six orientation markers, each positioned at one of the edges of the cell, and wherein each orientation marker comprises a unique base color.

18. The method of claim 1, further including shifting the game board from an expanded form to a compact form.

19. The method of claim 18, wherein in the expanded form the game board is shaped as a hexagon, and wherein in the compact form the game board is shaped as a triangle.

* * * * *